US009126073B2

(12) United States Patent
Ho et al.

(10) Patent No.: US 9,126,073 B2
(45) **Date of Patent: *Sep. 8, 2015**

(54) ABDOMEN EXERCISE MACHINE

(71) Applicants: Wei-Teh Ho, Taipei (TW); Willy Ho, Taipei (TW)

(72) Inventors: Wei-Teh Ho, Taipei (TW); Willy Ho, Taipei (TW)

( * ) Notice: Subject to any disclaimer, the term of this patent is extended or adjusted under 35 U.S.C. 154(b) by 125 days.

This patent is subject to a terminal disclaimer.

(21) Appl. No.: 13/941,008

(22) Filed: Jul. 12, 2013

(65) Prior Publication Data

US 2014/0274618 A1 Sep. 18, 2014

Related U.S. Application Data

(63) Continuation-in-part of application No. 13/914,522, filed on Jun. 10, 2013, which is a continuation-in-part of application No. 13/797,393, filed on Mar. 12, 2013.

(51) Int. Cl.

| | |
|---|---|
| ***A63B 26/00*** | (2006.01) |
| ***A63B 23/02*** | (2006.01) |
| *A63B 21/00* | (2006.01) |
| *A63B 69/00* | (2006.01) |

(52) U.S. Cl.

CPC ..... *A63B 23/0211* (2013.01); *A63B 21/1469* (2013.01); *A63B 21/1492* (2013.01); *A63B 21/159* (2013.01); *A63B 23/02* (2013.01); *A63B 21/1457* (2013.01); *A63B 2069/0062* (2013.01)

(58) Field of Classification Search

CPC ..... A63B 23/0205; A63B 23/0211
USPC ..... 482/140, 142, 79–80, 148, 57, 70–71, 482/96, 92–95, 131, 133, 137, 908; 297/353

See application file for complete search history.

(56) References Cited

U.S. PATENT DOCUMENTS

| | | | | |
|---|---|---|---|---|
| 5,308,306 | A | 5/1994 | Wang | |
| 5,971,897 | A * | 10/1999 | Olson et al. | 482/101 |
| 6,152,866 | A | 11/2000 | Kuo | |
| 6,287,243 | B1 | 9/2001 | Isom et al. | |
| 6,716,144 | B1 * | 4/2004 | Shifferaw | 482/140 |
| 8,062,196 | B1 * | 11/2011 | Khubani | 482/140 |
| 8,235,876 | B2 * | 8/2012 | Reyes | 482/140 |
| 2004/0067831 | A1 * | 4/2004 | Hou | 482/140 |

(Continued)

FOREIGN PATENT DOCUMENTS

| | | |
|---|---|---|
| DE | 20010072 | 8/2000 |
| DE | 20313843 | 11/2003 |
| DE | 202006008113 | 7/2006 |

OTHER PUBLICATIONS

EPO Communication for European Application No. 13189521.1 containing the Extended European Search Report and Opinion, (dated Jul. 14, 2014, received Feb. 26, 2015), 9 pages.

*Primary Examiner* — Loan H Thanh
*Assistant Examiner* — Megan Anderson
(74) *Attorney, Agent, or Firm* — Blakely Sokoloff Taylor Zafman LLP

(57) ABSTRACT

An exercise machine applicable for strengthening a user's abdominal muscles is described. The exercise machine can include a base frame to provide ground support, a mounting assembly rotably mounted over the base frame, a backrest assembly movably coupled to the mounting assembly via one or more pivot joints for swivel movements along the base frame and a handle assembly adjustably affixed to the backrest assembly to allow a user sitting on the seat pad to induce the swivel movements via the backrest assembly.

17 Claims, 9 Drawing Sheets

(56) References Cited

U.S. PATENT DOCUMENTS

| | | | | |
|---|---|---|---|---|
| 2004/0067931 | A1 | 4/2004 | Kelly et al. | |
| 2005/0101463 | A1 | 5/2005 | Chen | |
| 2007/0259762 | A1* | 11/2007 | Ho | 482/142 |
| 2008/0051274 | A1 | 2/2008 | Greene | |
| 2009/0105054 | A1* | 4/2009 | Boland et al. | 482/140 |
| 2009/0186749 | A1* | 7/2009 | Zhou | 482/140 |
| 2012/0058867 | A1* | 3/2012 | Mishan et al. | 482/140 |
| 2012/0065037 | A1 | 3/2012 | Chen et al. | |

* cited by examiner

300

500

600

700A

700B

ABDOMEN EXERCISE MACHINE

CROSS-REFERENCE TO RELATED APPLICATIONS

The present application is a continuation-in-part of, and claims the benefit of U.S. patent application Ser. No. 13/914,522, filed on Jun. 10, 2013, entitled "ABDOMEN EXERCISE MACHINE", which is a continuation-in-part application of U.S. patent application Ser. No. 13/797,393, filed on Mar. 12, 2013, entitled "ABDOMEN EXERCISE MACHINE", both of which are hereby incorporated by reference in their entirety into this application.

FIELD OF INVENTION

The present invention relates generally to physical training machines, and in particular, exercise machines structured to support twistable body bending for exercising the abdominal muscles of a user.

BACKGROUND

With the growing awareness of health problems caused by lack of exercise, popularity of exercising machines has been continuously increasing. Typically, these machines are designed for movements of specific parts of the body. For example, abdominal machines may be structured to induce body exercises to strengthen the abdominal muscles.

Existing abdominal machines, however, are usually designed based on variations of sit-ups exercises. Effective abdominal exercises may require a combination of movements involving muscles of different parts of the body including the waist, legs, etc. Although there are many exercising machines available for exercising different parts of the body, these multipurpose exercising machines are usually heavy and expensive devices. Further, these devices are often directed for a user to perform one degree of exercise movements at a time.

Therefore, traditional abdomen machines are not structured economically and effectively to facilitate a user to exercise abdomen muscles with multi degrees of movements at a time.

SUMMARY OF THE DESCRIPTION

An exercise machine supporting twistable body bending for strengthening a user's abdominal muscles (e.g. allowing twistable pivoting movements) can include a base frame to provide ground support, a mounting assembly rotatably mounted over the base frame, a backrest assembly movably coupled to the mounting assembly via one or more pivot joints for swivel movements along the base frame and a handle assembly adjustably affixed to the backrest assembly to allow a user sitting on the seat pad to induce the swivel movements via the backrest assembly. The base frame can have a seat pad disposed between a front portion and a rear portion of the base frame. The mounting assembly can have a swivel pivot joint with at least two rotatable structures associated with two rotating axes. The swivel pivot joint can allow swivel movements simultaneous rotating around at least the two rotating axes. The backrest assembly may include a backrest pad and a backrest support structure affixed to the backrest pad. The backrest pad can have a front end and a rear end. The backrest support structure may be coupled with the swivel joint at the front end of the backrest pad to support the swivel movements for the backrest pad.

Other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further specific numeric references such as first, second, third, etc., may be made. However, the specific numeric references should not be interpreted as a literal sequential order but rather interpreted as references to different objects. Thus, the specific details set forth are merely exemplary. The specific details may be varied from and still be contemplated to be within the spirit and scope of the present invention. A reference number may refer to one embodiment or one of separate embodiments of a common subject.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
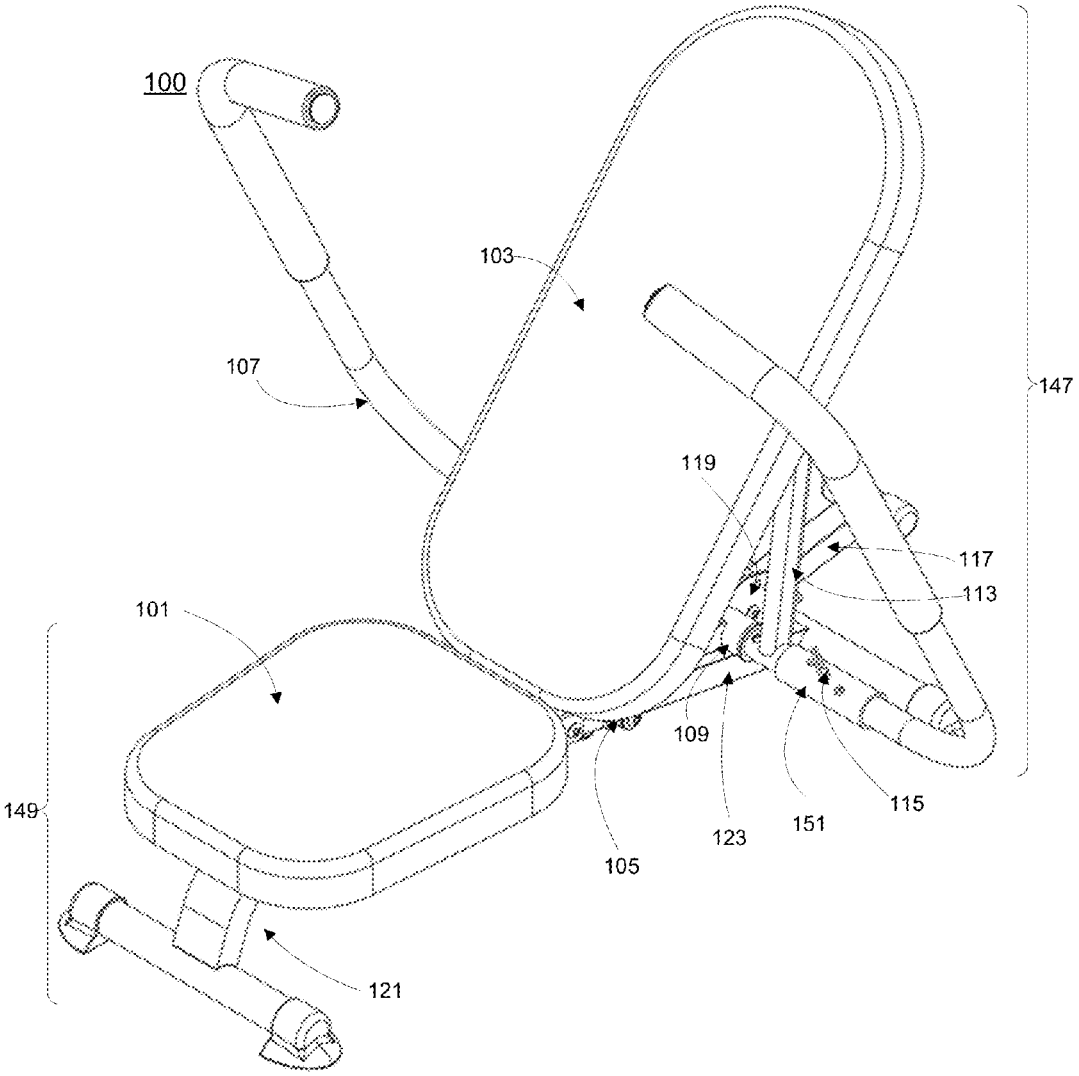
FIG. 1 is a perspective view of an embodiment of an exercise machine assembly.

FIG. 1 is a perspective view of an embodiment of an exercise machine assembly. Exercise machine (or device) 100 can include pivoting frame 147 rotatably mounted on a mounting location of base frame 149 to allow pivoting frame 147 to move rotationally and/or pivotally around the mounting location for a user to perform twisting exercise movements along multiple rotational or bending degrees, such as up down pivoting with simultaneous left right twisting.

Base frame 149 can provide floor (or ground) support for movements of pivoting frame 147. In one embodiment, base frame 149 may be oriented longitudinally along a rear side (or portion) and a front side (or portion). Seat pad 101 may be affixed on top of base frame 149. In some embodiments, seat pad 101 may be disposed between the front portion and the rear portion of based frame 149.

Seat pad 101 may be elevated to provide seating support for a user of exercise machine 100. Base frame 149 may include front legs 121 on the front side and rear legs 123 on the rear side. Elevation of base frame 149 may be adjustable to provide proper foot positions for a user sitting on seat pad 101. For example, front legs 121 may have a height low enough for the user to restrain both feet on the floor when sitting on seat pad 101 to perform exercise movements. Alternatively, a foot restraint bar may be detachably affixed to front legs 121 to provide foot support.

Pivoting frame 147 may include mounting assembly 129 rotatably mounted on base frame 149 over real legs 123 (or on the rear portion of base frame 149) to allow pivoting frame 147 to be longitudinally oriented (e.g. aligned) or having an angular relationship with a longitudinal direction of base frame 149. Mounting assembly 129 can include more or more rotatable joints including a swivel pivot joint. Each rotatable joint may provide pivoting or rotating support around at least one axis. A swivel pivot joint may have two or more rotatable structures (e.g. a pivoting rod or rotatable rod) associated with two or more axes provide pivoting support around these axes.

For example, mounting assembly 129 can include front pivot joint 105 and rear pivot joint 109 to enable pivot movements of pivoting frame 147. Front pivot joint 105 may be a swivel pivot joint to allow both up/down and left/right rotations of pivoting frame 147. Thus, a user of device 100 can sit on seat pad 101 of base frame 149 to perform exercise movements folding or twisting the user's upper body via the pivot movements of pivoting frame 147.

In one embodiment, pivot frame 147 can include a backrest assembly pivotally coupled to mounting assembly 129 via, for example, front pivot joint 105 and rear pivot joint 109. The backrest assembly may be capable of swivel movements longitudinally along base frame 149. Swivel movements may include simultaneous rotating or pivoting around at least two rotating axes, such as up down (vertical) movements and left right (or horizontal) movements The backrest assembly can include a backrest support structure and backrest pad 103 affixed to the backrest support structure. Backrest pad 103 may have a front end and a rear end. The backrest support structure may be pivotally coupled with the mounting assembly via the swivel joint at the front end of backrest pad 103 to support the swivel movements for backrest pad 103. In one embodiment, the backrest support structure can include lever bars 113 pivotally coupled with the mounting assembly via rear pivot joint 109 to enable, for example, up and down pivoting movements. Backrest pad 103 can provide support to a user's upper back to make bending or twisting movements via pivot frame 147 while sitting on seat pad 101.

In one embodiment, pushing/resisting forces may be applied via the backside of backrest pad 103 for pivoting movements of pivoting frame 147 via lever bars 113. For example, the front lever ends of lever bars 113 towards the front (or forward) direction of backrest pad 103 may be pivotally coupled with mounting assembly 129 at rear pivot joint 109. Lever bars 113 may rotate pivotally around rear pivot joint 109 to push or receive backrest pad 103 via the rear ends (or upper ends) of lever bars 113.

Figure 2:
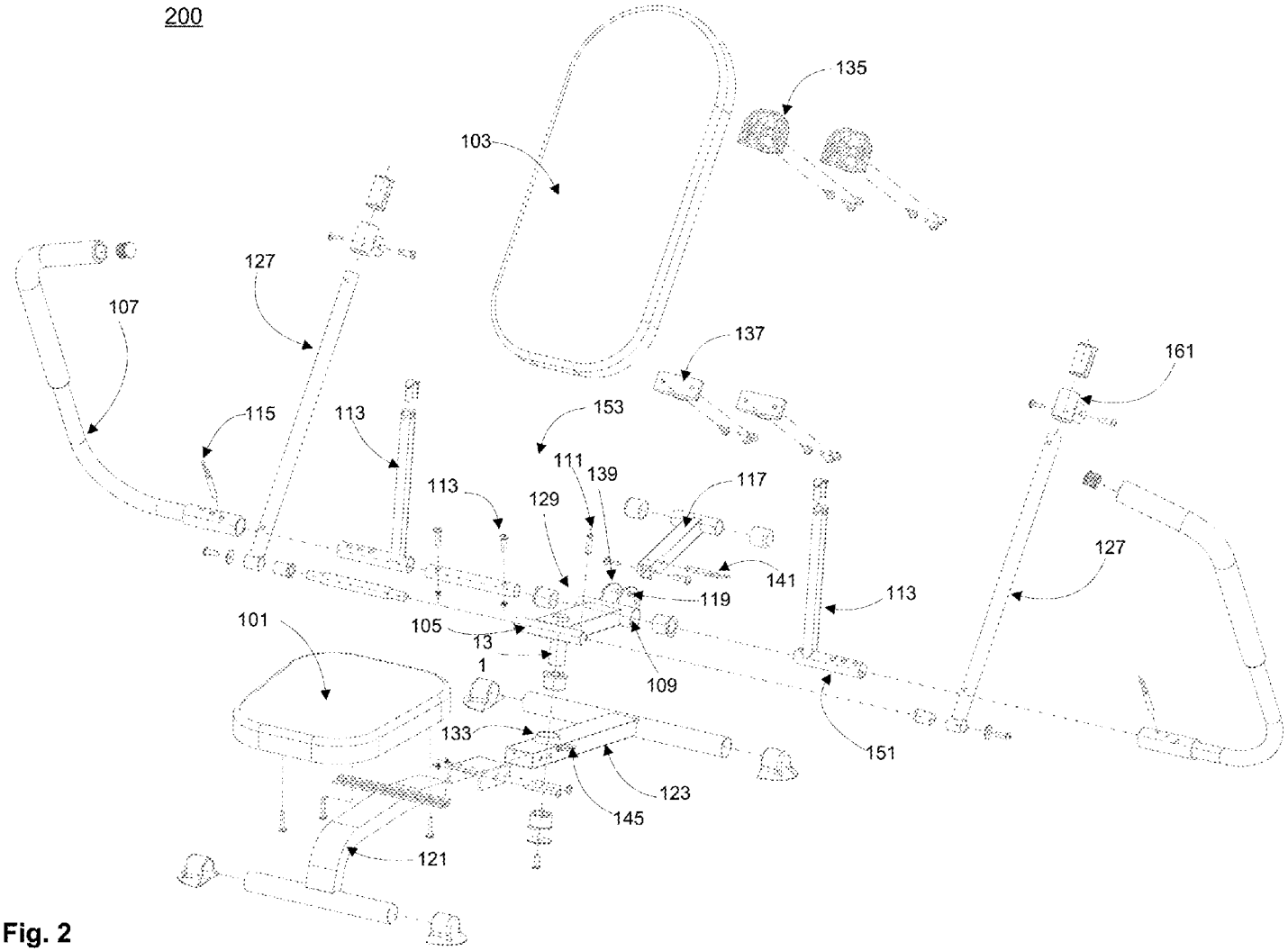
FIG. 2 is an exploded perspective view of an embodiment of an exercise machine assembly.

Pivoting frame 147 may include mounting assembly (e.g. as shown in FIG. 2) rotatably mounted on base frame 149 over rear legs 123 (or on the rear portion of base frame 149) to allow pivoting frame 147 to be longitudinally oriented (e.g. aligned) or having an angular relationship with a longitudinal direction of base frame 149. Mounting assembly 129 can include one or more rotatable joints including a swivel pivot joint. Each rotatable joint may provide pivoting or rotating support around at least one axis. A swivel pivot joint may have two or more rotatable structures (e.g. a pivoting rod or rotatable rod) associated with two or more axes provide pivoting support around these axes.

In one embodiment, device 100 may include an adjustable control mechanism to control swivel movements (e.g. multi-degrees or dimensions of rotational and/or pivoting or other applicable motions) of pivoting frame 147 via mounting assembly 129. The adjustable control mechanism can include position bar 117 for a height control and an alignment pin insert to provide constraints on movement paths or manners of pivot frame 147. For example, the alignment pin my be latched to confine the swivel movements with one rotating axis (e.g. up down pivoting).

Position bar 117 may be adjustably attached to the rear end or rear side of mounting assembly 129 to configure a stop height or a lowest level for backrest pad 103 to pivot backwards. In one embodiment, height control 117 may be pivotally positioned around rear pivot joint 109 at the lower end of height control 117 via one of a fixed number (e.g. 4, 5, 6 or other applicable number) of apertures 119. Each aperture 119 may correspond to a different height at the higher end of position bar 117 to stop the rear end of backrest pad 103 to define, for example, a starting position for a user to make forward swivel, bending or pivoting movements.

FIG. 2 is an exploded perspective view of an embodiment of an exercise machine assembly as shown in FIG. 1. For example, the backrest support structure (of the backrest assembly) can include backrest support brackets 135, 137 fixedly attached to the backside of backrest pad 103 transversely. The backrest support structure can further include backrest support bars (or guide bars) 127 affixed to the backside of backrest pad 103 via backrest support brackets 135, 137. Backrest support bars 127 may be pivotally coupled to front pivot joint 105 via the front ends of backrest support bars 127 to enable pivoting movement of, for example, backrest pad 103.

In one embodiment, the rear ends (or upper ends) of lever bars 113 may be slidably coupled (e.g. separately on left and right sides under backrest pad 103) with the backrest support bars 127 in a pivoting manner. For example, the rear ends of lever bars 113 may be affixed to bearing sleeves 161 which are slidable along support bars 127. Thus, the rear ends of lever bars 113 can slide or move longitudinally across backrest support bars 127 while pivoting around rear pivot joint 109 to allow lever bars 113 to apply pushing or resisting forces for the pivoting movement of backrest support bars 127.

In some embodiments, the backrest assembly can include pivot rods 151 (one or more) detachably affixed transversely to lever bars 113 at the rear ends of the lever bars 113. Pivot rods 151 may be pivotably attached to rear pivot joint 109 of the mounting assembly. Handles bars 107 may be detachably affixed to pivot rods 151 to form an adjustable angular relationship between handle bars 107 and backrest pad 103 via, for example, pin insert 115 to facility hand gripping.

Mounting assembly 129 in pivoting frame 147 of FIG. 1 may include a horizontal rotatable structure having protruding rod rotatably coupled to receiver structure 133 with a center opening directed upward, e.g. substantially perpendicular to the longitudinal direction of rear legs 123. Protruding rod 131 may extend downwardly into the center opening of receiver structure 133 for mounting base frame 149 with pivoting frame 147 of FIG. 1. Protruding rod 131 may be arranged transversely to pivot joint 105 to allow mounting assembly 129 to rotate around receiver structure 133.

According to one embodiment, mounting assembly 129 may include position locking structure 139, for example, arranged near real pivot joint 109. Position locking structure 139 may be configured with apertures 119 circumferentially spaced (e.g. equally) to adjustably lock in position bar 117 pivotally for a height control. The lower end of position bar 117 may be pivotally affixed to position locking structure 139 includes via height locking pin 141 selecting one of apertures 119.

An adjustable control mechanism can include position bar 117 of a height control and alignment pin 111. In one embodiment, alignment pin 111 can be inserted to latch rotational positions between base frame 149 and pivoting frame 147 of FIG. 1. For example, mounting assembly 129 can include an upper latching hole. Base frame 149 can include a lower latching hole 145 to be mated with the upper latching hole. When alignment pin 111 is inserted through the upper latching hole and lower latching hole 145, backrest pad 103 and seat pad 101 may be substantially aligned longitudinally to allow a user to focus on body up down pivoting movements without left right rotational twisting effects. Without alignment pin 111 (e.g. when removed), backrest pad 103 and seat pad 101 may not be aligned to cause twisting or swiveling forces for exercising. Backrest pad 103 and seat pad 101 may be positioned with enough space in between each other to allow rotational and/or pivoting movements of backrest pad 103.

Figure 3A:
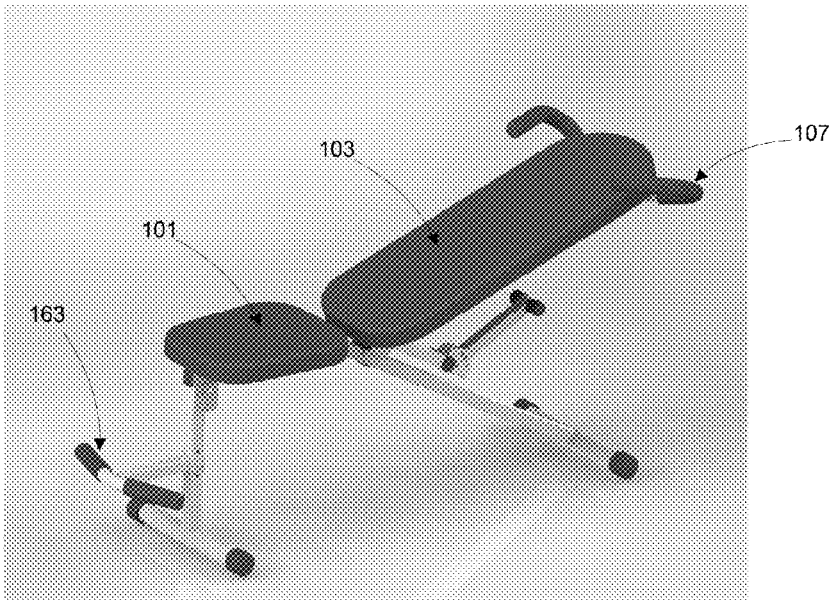
FIGS. 3A-3C are separate views of an alternative embodiment of the present invention.
Figure 3B:
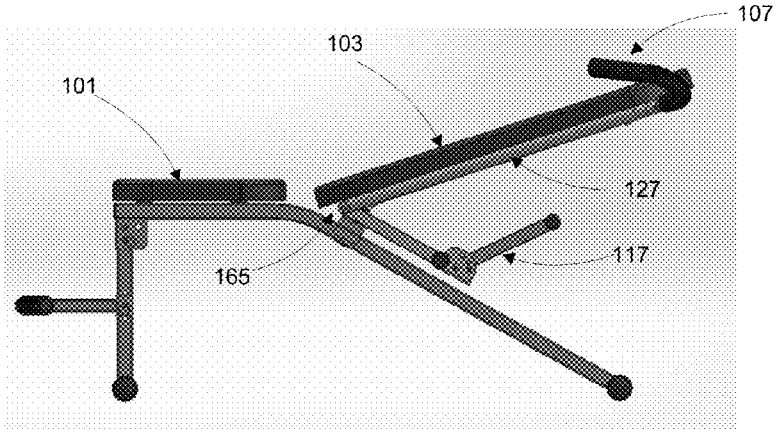
Figure 3C:
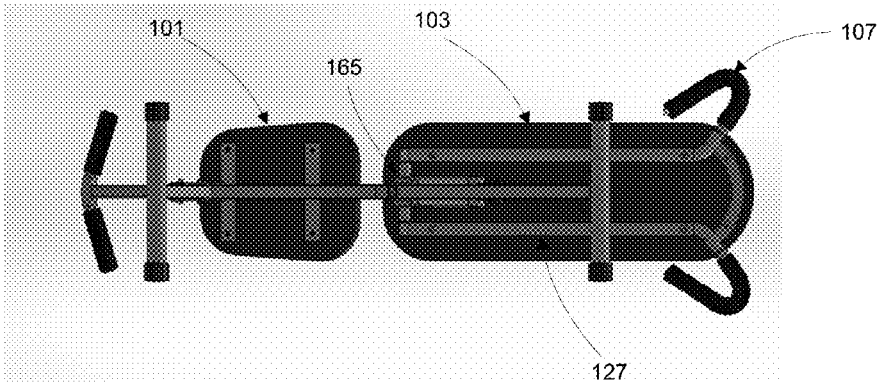

FIGS. 3A-3C are separate views of an alternative embodiment of the present invention. Machine 300, for example, may include similar components of machine 100 of FIG. 1, such as a base frame including seat pad 101, a backrest assembly including backrest pad 103, a mounting assembly including swivel joint 165, a handle assembly including handle bars 107, a control assembly including height control 117 or other applicable components, etc. Foot constraint 163, as shown in FIG. 3A, may provide foot support for a user of machine 300 having a base frame with an elevated height level (from the floor).

Turning now to FIG. 3B, the backrest assembly of machine 300 may include backrest bars 127. The handle assembly may include handle bars 107 adjustably affixed to the rear ends of the backrest support structure. The mounting assembly may include swivel joint 165 pivotally coupled with the backrest bars 127 at the front end of the backrest assembly. The backrest bars 127, as shown in FIG. 3C, may be affixed to the backside of backrest pad 103 to allow hand push/pull force via handle bars 107 to make swivel movements via backrest pad 103.

Figure 4A:
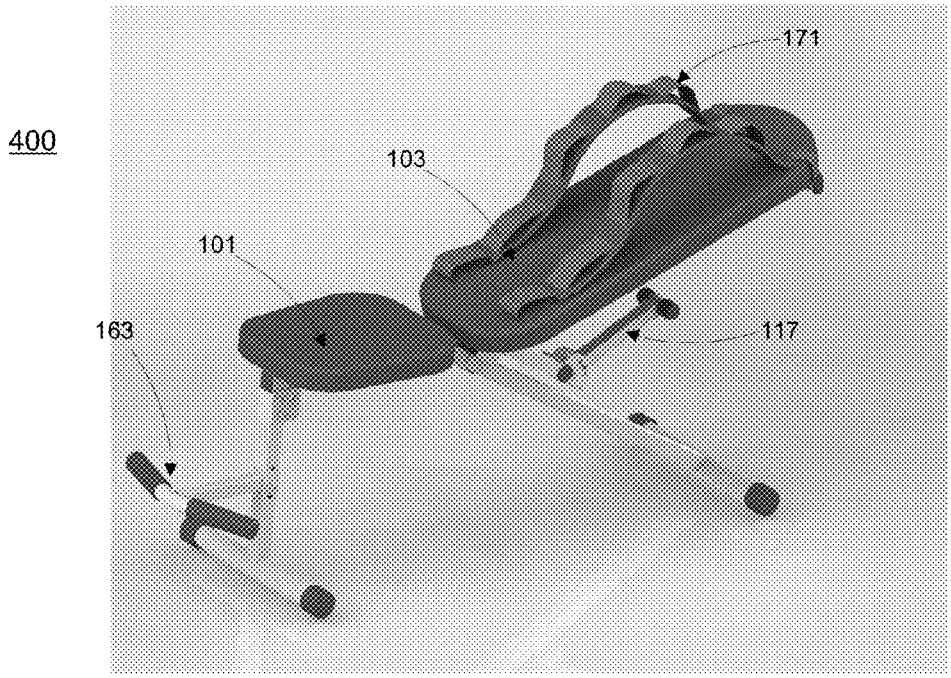
FIGS. 4A-4B are separate views of another embodiment of the present invention.
Figure 4B:
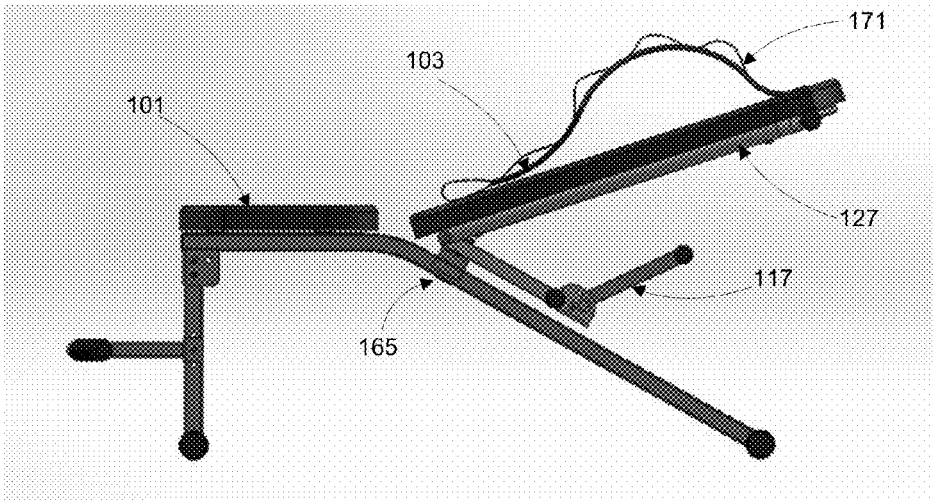

FIGS. 4A-4B are separate views of another embodiment of the present invention. Machine 400, for example, may include similar components of machine 100 of FIG. 1, such as a base frame including seat pad 101, a backrest assembly including backrest pad 103, a mounting assembly including swivel joint 165, a handle assembly, a control assembly including height control 117 or other applicable components, etc. Foot constraint 163 of FIG. 4A may be optional and not needed if the elevation of the base frame is low enough for a user to support the exercise movement with feet resting on the floor.

The handle assembly of machine 400 may include handle belts 171 disposed over front side of backrest pad 103 allow the user to move the backrest assembly via hand pushing/pulling force. As shown in FIG. 4B, swivel joint 165 may be pivotally coupled with the backrest bars 127 at the front end of the backrest assembly. Handle belts 171 may be adjustably affixed to the rear end of the backrest bars 127.

Figure 5A:
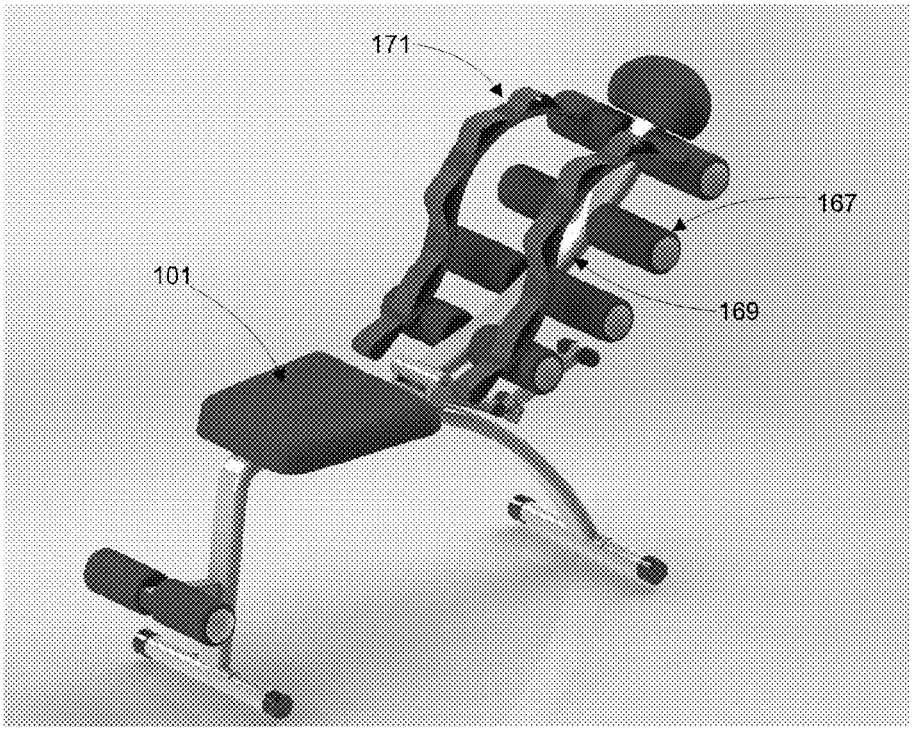
FIGS. 5A-5B are separate views of yet another embodiment of the present invention.
Figure 5B:
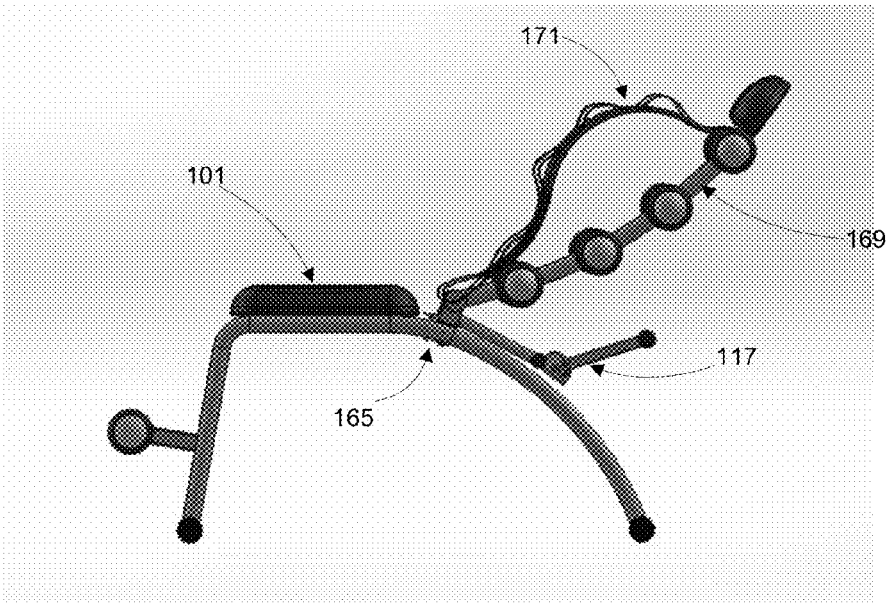

FIGS. 5A-5B are separate views of yet another embodiment of the present invention. Machine 500, for example, may include similar components of machine 100 of FIG. 1, such as a base frame including seat pad 101, a backrest assembly, a mounting assembly, a handle assembly, a control assembly including height control 117 or other applicable components, etc. The handle assembly of machine 500 may include handle belts 171 disposed over the front side of the backrest assembly. In one embodiment, the backrest assembly includes horizontal backrest bars 167 and longitudinal backrest bar 169. As shown in FIG. 5B, the mounting assembly may have swivel joint 165 pivotally coupled with the longitudinal backrest bar 169 at the front end of the backrest assembly to support the swivel movements.

Figure 6A:
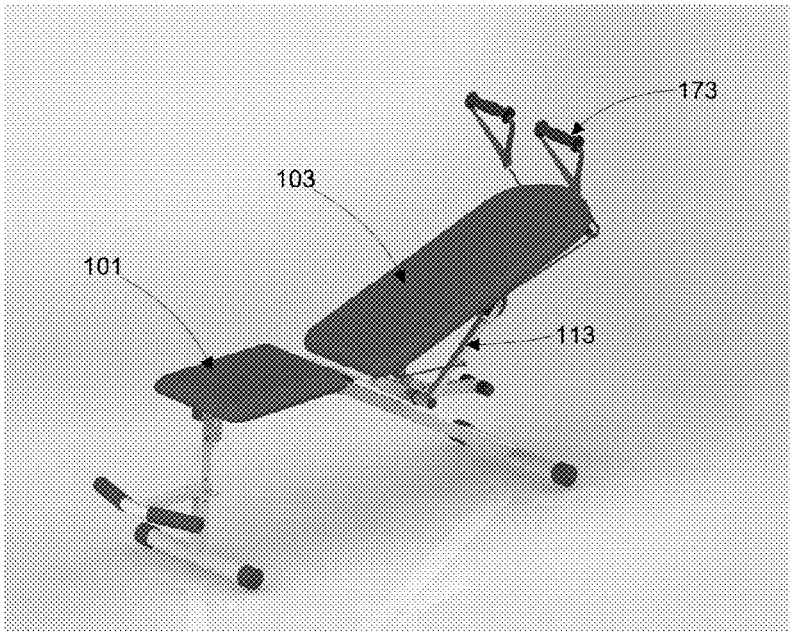
FIGS. 6A-6C are separate views of yet another embodiment of the present invention.
Figure 6B:
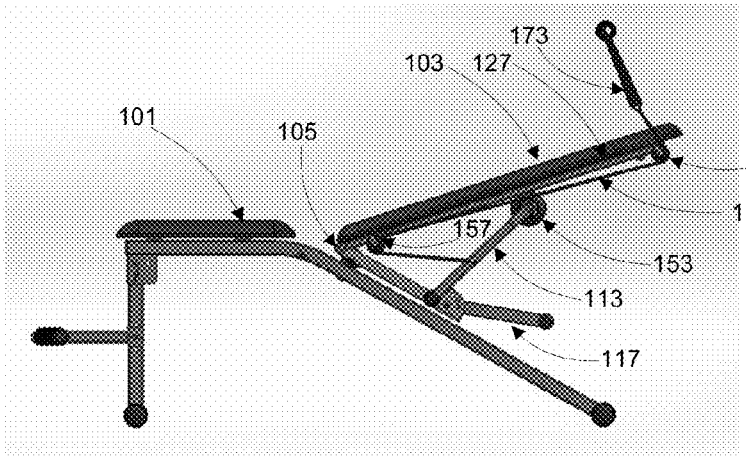
Figure 6C:
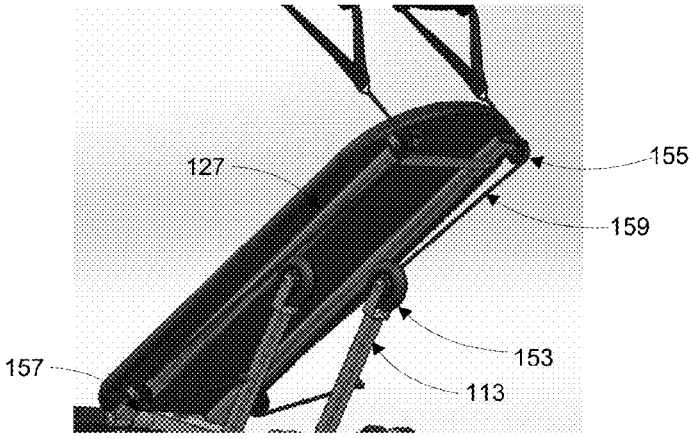

FIGS. 6A-6C are separate views of yet another embodiment of the present invention. Machine 600, for example, may include similar components of machine 100 of FIG. 1, such as a base frame including seat pad 101, a backrest assembly including backrest pad 103, a mounting assembly, a handle assembly, a control assembly including height control 117 or other applicable components, etc. The handle assembly may include hand holders 173 affixed to one end of hand ropes 159 in FIG. 6A. The other ends of hand ropes 159 may be coupled with lever bars 113 to allow a pulling force applied via hand holders 173 to move lever bars 113 to induce swivel movements of the backrest assembly.

Turning now to FIG. 6B, the backrest assembly may include a backrest support structure having track bars 127 movably coupled with lever bars 113. In one embodiment, the rear ends of lever bars 113 may include wheels 153 rollable along track bars 127. The backrest support structure may include a pully system for guiding the movement of hand ropes 159. For example, hand ropes 159 may be movably arranged through pullies 155, 157 of the pully system. As illustrate in FIG. 6C, lever bars 113 may push up the backrest pad via pulling force applied to hand grabbers 107.

Figure 7:
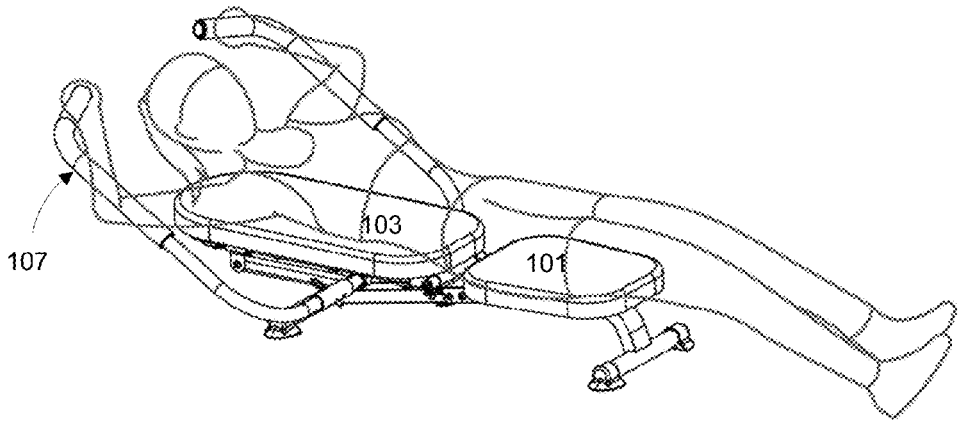
FIG. 7 shows a first example of an application of an exercise machine according to one embodiment of the present invention.
Figure 7:
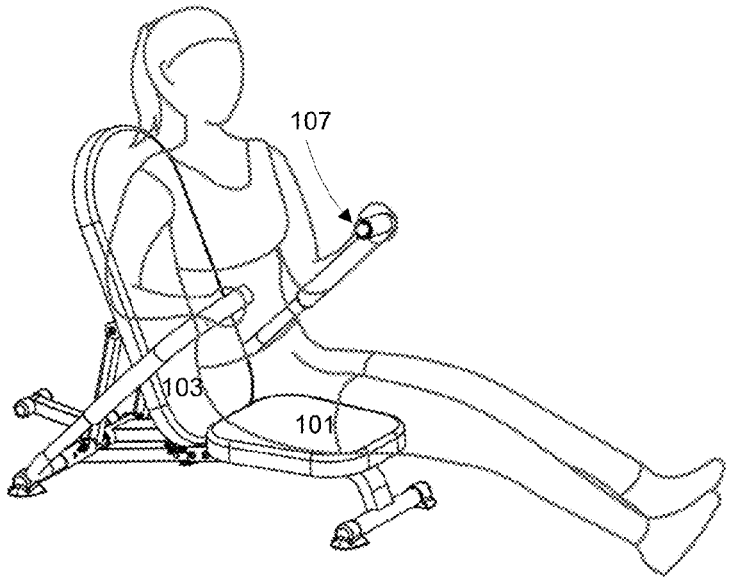

FIG. 7 shows a first example of an application of an exercise machine according to one embodiment of the present invention, such as device 1 of FIG. 1. Backrest pad 103 and seat pad 101 may be aligned longitudinally together during the movements. Starting positions (e.g. lowest positions of the upper end) of backrest pad 103 may be configured via, for example, position control bar 117 of FIG. 1 with different degrees of pivoting positions. A user could apply arm strength and/or waist strength to perform supine actions up and down as shown in examples 700A-700B.

Figure 8:
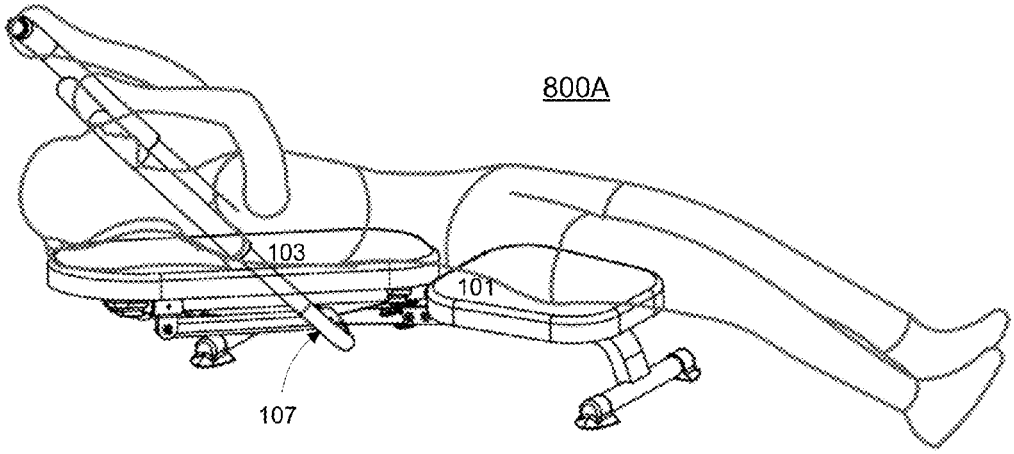
FIG. 8 shows a second example of an application of an exercise machine according to one embodiment of the present invention.
Figure 8:
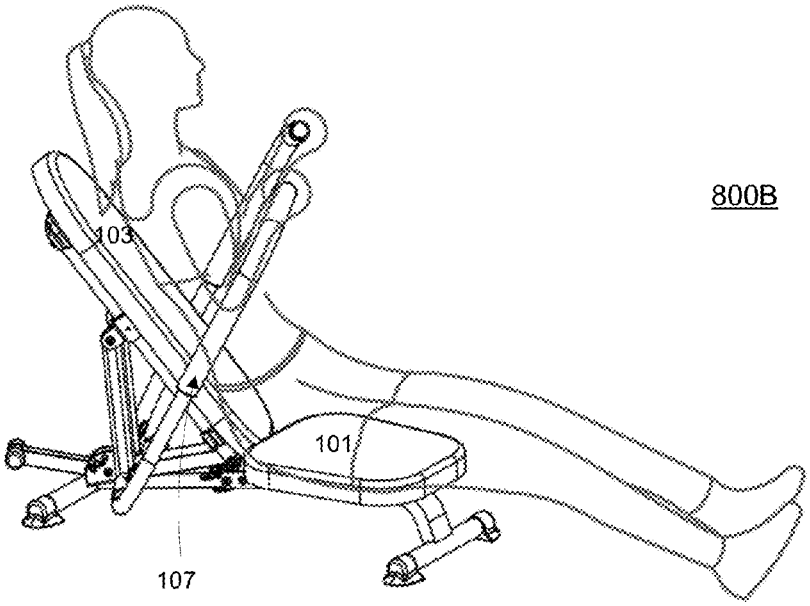

FIG. 8 shows a second example of an application of an exercise machine according to one embodiment of the present invention, such as device 100 of FIG. 1. Backrest pad 103 may twist or swivel freely relative to seat pad 101. The starting height of backrest pad 103 can be adjusted via, for example, position control bar 117 of FIG. 1. A user could perform pivoting movements with right twisting as shown in examples 800A-800B.

Figure 9:
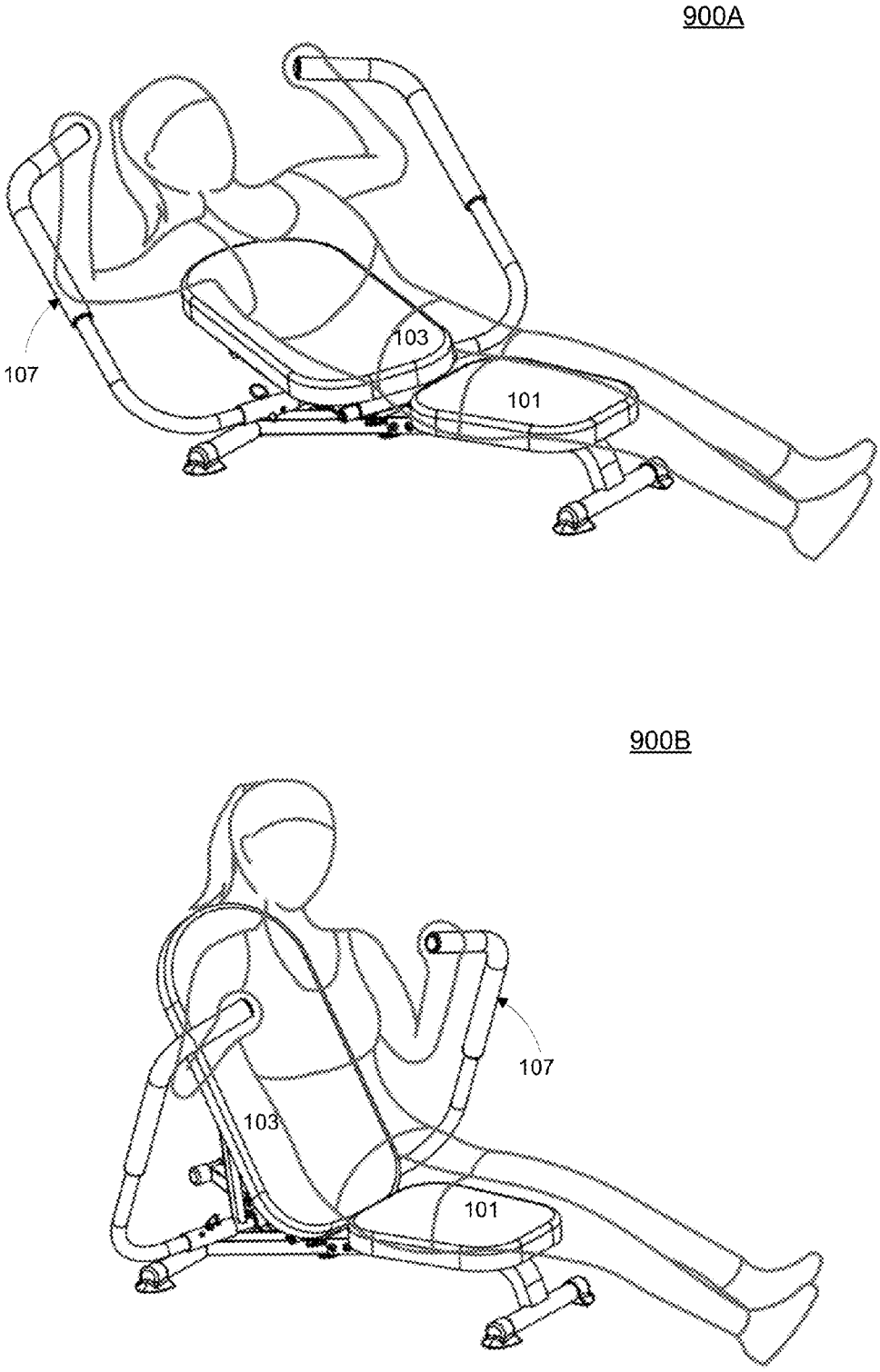
FIG. 9 shows a third example of an application of an exercise machine according to one embodiment of the present invention.

FIG. 9 shows a third example of an application of an exercise machine according to one embodiment of the present invention, such as device 100 of FIG. 1. In one embodiment, a user could perform pivoting movements with left twisting as shown in examples 900A-900B.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercising machine comprising:

a base frame to provide ground support, the base frame having a seat pad disposed between a front portion and a rear portion of the base frame;

a mounting assembly rotatably mounted via a horizontal rotatable structure over the rear portion of the base frame, the mounting assembly having at least two pivot joints including a swivel pivot joint and a rear pivot joint, the swivel pivot joint having at least two rotatable structures associated with two rotating axes, the two rotating axes including a horizontal axis and a vertical axis, the at least two rotatable structures including the horizontal rotatable structure for rotating around the vertical axis and a vertical rotatable structure for rotating around the horizontal axis, wherein the vertical rotatable structure and the rear pivot joint define a longitudinal direction of the mounting assembly, wherein the horizontal rotatable structure is arranged in the mounting assembly between the vertical rotatable structure and the rear pivot joint along the longitudinal direction of the mounting structure, and wherein the swivel pivot joint allows swivel movements simultaneous rotating around the at least the two rotating axes;

a backrest assembly movably coupled to the mounting assembly via the at least one pivot joint for swivel movements along the base frame, the backrest assembly including backrest pad and backrest support structure affixed to the backrest pad, the backrest pad having a front end and a rear end, the backrest support structure coupled with the swivel joint at the front end of the backrest pad to support the swivel movements for the backrest pad; and a handle assembly adjustably affixed to the backrest assembly to allow a user sitting on the seat pad to induce the swivel movements via the backrest pad.

2. The exercising machine of claim 1, wherein the swivel movements include up and down pivoting movements and left and right pivoting movements, the up and down movements rotating around the horizontal axis, and the left and right pivoting movements around the vertical axis.

3. The exercising machine of claim 2, wherein the backrest assembly includes lever bars, wherein front ends of the lever bars are pivotally coupled to the rear pivot joint, and wherein rear ends of the lever bars are pivotally coupled with backrest support structure, the rear ends of the lever bars movable along the backrest support structure to cause the swivel movements around the horizontal axis.

4. The exercising machine of claim 3, wherein the backrest support structure includes track bars and wherein the rear ends of the lever bars are affixed with wheels rollable along the track bars.

5. The exercising machine of claim 3, wherein the backrest support structure includes guide bars and wherein the rear ends of the lever bars are affixed with bearing sleeves slidable along the guide bars.

6. The exercising machine of claim 3, wherein the handle assembly includes handle bars adjustably affixed transversely to the lever bars at the rear pivot joint.

7. The exercising machine of claim 6, wherein the backrest assembly includes a pivot rod detachably affixed to the lever bars at the rear ends of the lever bars, the pivot rod pivotably attached to the rear pivot joint of the mounting assembly, wherein the handle bars are affixed adjustably to both ends of the pivot rod to allow separate angular relationships between the handle bars and the backrest pad.

8. The exercising machine of claim 3, wherein the backrest support structures are affixed with one or more pulleys, wherein the handle assembly includes handle ropes having hand holders, the handle ropes movably arranged through the pulleys, each handle rope affixed to one of the lever bars to allow the lever bars to push up the backrest pad via pulling force via the hand holders.

9. The exercising machine of claim 2, wherein the handle assembly includes handle bars adjustably affixed to the rear ends of the backrest support structure.

10. The exercising machine of claim 2, wherein the handle assembly includes handle belts disposed over front side of the backrest pad, the handle belts adjustably affixed the backrest support structure.

11. The exercising machine of claim 1, further comprising:

an adjustable control mechanism to constraint the swivel movements, the adjustable control mechanism comprising a height control adjustably attached to the mounting assembly to provide a stop height support for the rear end of the backrest pad.

12. The exercising machine of claim 11, the adjustable control mechanism further comprising an alignment pin to confine the swivel movements with one of the rotating axes.

13. The exercise machine of claim 12, wherein the mounting assembly includes an upper latching hole, wherein the base frame includes a lower latching hole and wherein rotational positions between the seat pad and the backrest pad are latched when the alignment pin is inserted through both the upper latching hole and the lower latching hole.

14. The exercising machine of claim 11, wherein the mounting assembly includes a position locking structure, wherein the height control includes a position bar having a higher end and a lower end, the position bar pivotally affixed to the position locking structure via the lower end with an adjustable pivoting position, the higher end positioned at an adjustable height corresponding to the adjustable pivoting position to provide the stop height support of the backrest pad.

15. The exercising machine of claim 14, wherein the position locking structure includes apertures circumferentially spaced for the adjustable pivoting position, and wherein the height control includes a height locking pin to engage the position bar and the position locking structure via one of the apertures.

16. The exercising machine of claim 1, wherein the horizontal rotatable structure has a protruding rod and a receiver structure with a center opening, the receiver structure affixed to the base frame, the protruding rod extending into the center opening to allow the mounting assembly to rotate left and right around the base frame.

17. An exercising machine comprising:

a base frame to provide floor support, the base frame arranged longitudinally between a front side and a rear side, the base frame including a seat pad affixed on top of the base frame;

a pivoting frame rotatably mounted on the rear side of the base frame, the pivoting frame having a backrest assembly, a mounting assembly and a handle assembly, the backrest assembly capable of swivel movements along the base frame, wherein the backrest assembly has a backrest pad affixed to a backrest support structure, the backrest rest support structure pivotally coupled with the mounting assembly, wherein the mounting assembly has at least two rotatable joints including a swivel pivot joint and a rear pivot joint, the swivel pivot joint having a horizontal rotatable structure for rotating around a vertical axis and a vertical rotatable structure for rotating around a horizontal axis, wherein the vertical rotatable structure and the rear pivot joint define a longitudinal direction of the mounting assembly, the horizontal rotatable structure arranged in the mounting assembly between the vertical rotatable structure and the rear pivot joint along the longitudinal direction of the mounting assembly, the base frame engaged with the mounting assembly via the swivel pivot joint for the rotatable mounting to allow angular relationship between longitudinal directions of the seat pad and the backrest pad, wherein the handle assembly is affixed to the backrest support structure to allow a user to make push/pull force to cause the swivel movements of the backrest pad, and wherein the angular relationship allows twisting effects on the user while exercising with the backrest pad via the swivel movements.

* * * * *